US011131098B1

(12) United States Patent
Matuszewski

(10) Patent No.: US 11,131,098 B1
(45) Date of Patent: Sep. 28, 2021

(54) DRIP CAP WATER MANAGEMENT DEVICE AND SYSTEM

(71) Applicant: LOUISIANA-PACIFIC CORPORATION, Nashville, TN (US)

(72) Inventor: Aaron Matuszewski, Green Bay, WI (US)

(73) Assignee: LOUISIANA-PACIFIC CORPORATION, Nashville, TN (US)

( * ) Notice: Subject to any disclaimer, the term of this patent is extended or adjusted under 35 U.S.C. 154(b) by 0 days.

(21) Appl. No.: 17/020,892

(22) Filed: Sep. 15, 2020

Related U.S. Application Data

(60) Provisional application No. 63/040,116, filed on Jun. 17, 2020.

(51) Int. Cl.
*E04F 13/08* (2006.01)

(52) U.S. Cl.
CPC ..... *E04F 13/0898* (2013.01)

(58) Field of Classification Search
CPC ..... E04F 13/0864; E04F 13/0889; E04F 21/1855; E04F 13/0898; E04B 1/64
See application file for complete search history.

(56) References Cited

U.S. PATENT DOCUMENTS 1,379,516 A * 5/1921 Benjamin ..... E04B 1/62 52/62
2,292,984 A * 8/1942 Alvarez, Jr. ..... E04F 13/0846 52/471
2,293,744 A * 8/1942 Miles ..... E04F 13/007 52/547
3,818,668 A * 6/1974 Charniga ..... E04F 13/0864 52/547
4,155,175 A * 5/1979 Stiles ..... G01B 3/30 33/646
4,425,714 A * 1/1984 Kelly, Jr. ..... E04F 21/1855 33/646
4,485,600 A * 12/1984 Olson ..... E04F 13/10 52/396.07
4,698,942 A * 10/1987 Swartz ..... E04F 21/1855 52/547
5,586,415 A * 12/1996 Fisher ..... E06B 1/62 52/58

(Continued)

*Primary Examiner* — Rodney Mintz
(74) *Attorney, Agent, or Firm* — Wayne Edward Ramage; Baker Donelson

(57) ABSTRACT

An improved flashing system and apparatus. A drip cap is attached to the back side of a panel or board, and extends across the top of the panel or board with a short angled drip section and edge extending downwards on the front side of the panel or board. The drip cap may comprise a single piece of metal, or other suitable materials, including but not limited to plastic, formed by folding or by stamping or molding. The back of the drip cap has an upper section extending upward, and also may have a lower section extending downward. The drip cap may be attached by glue or other adhesive means. The lower section, if present, may attached to the back of the panel or board by fastening means known in the art, such as, but not limited to, staples or nails that penetrate only the lower section and the back of the panel or board. The drip cap prevents water and moisture from penetrating behind the panel or board after installation.

19 Claims, 11 Drawing Sheets

(56) References Cited

U.S. PATENT DOCUMENTS 6,052,961 A * 4/2000 Gibbs ..... E04D 1/16 52/518
7,434,329 B2 * 10/2008 Walda ..... E04F 21/1855 33/649
7,490,447 B2 * 2/2009 Ouellette ..... E04F 21/1855 33/645
7,584,587 B2 * 9/2009 Ouellette ..... E04F 13/0889 33/646
7,721,488 B1 * 5/2010 Bennett ..... E04F 13/0864 52/58
7,784,222 B2 * 8/2010 Bennett ..... E04F 13/0864 52/58
7,836,652 B2 * 11/2010 Futterman ..... E04F 13/04 52/417
8,448,401 B2 * 5/2013 Schaefer ..... E04F 13/0864 52/533
9,458,624 B2 * 10/2016 Colyn ..... E04F 13/148
9,624,675 B2 * 4/2017 Schaefer ..... E04F 13/0832
9,951,514 B2 * 4/2018 Debuff ..... E04F 19/00
10,202,757 B2 * 2/2019 Kadavy ..... E04B 1/70
10,301,816 B2 * 5/2019 DeBuff ..... E04F 13/0833
10,544,578 B2 * 1/2020 DeBuff ..... E04F 19/00
10,900,221 B2 * 1/2021 McEndree ..... E04F 21/1855
2002/0023366 A1 * 2/2002 Bueno ..... E04D 1/2918 33/647
2002/0174618 A1 * 11/2002 Carroll ..... E04F 21/1855 52/520
2004/0237443 A1 * 12/2004 Haley ..... E04F 13/0823 52/545
2005/0262792 A1 * 12/2005 Walda ..... E04F 13/0864 52/547
2006/0269713 A1 * 11/2006 Zuege ..... B32B 25/042 428/40.1
2006/0272258 A1 * 12/2006 Pollock ..... E04F 21/1855 52/543
2007/0054086 A1 * 3/2007 Pagel ..... C08K 5/0008 428/106
2007/0055007 A1 * 3/2007 Pagel ..... C08K 5/0008 524/569
2007/0068115 A1 * 3/2007 Ouellette ..... E04F 21/1855 52/749.1
2007/0157528 A1 * 7/2007 Gawoski ..... E06B 1/62 52/58
2008/0008880 A1 * 1/2008 Walda ..... E04F 21/1855 428/343
2008/0209834 A1 * 9/2008 Ouellette ..... E04F 21/1855 52/518
2008/0209851 A1 * 9/2008 Ouellette ..... E04F 13/0889 52/749.1
2008/0318019 A1 * 12/2008 Walda ..... E04F 21/1855 428/220
2009/0064599 A1 * 3/2009 Bennett ..... E04F 13/0864 52/60
2010/0218434 A1 * 9/2010 Bennett ..... E04F 13/0889 52/58
2012/0042604 A1 * 2/2012 Walda ..... E04F 21/1855 52/741.4
2012/0047837 A1 * 3/2012 Schaefer ..... E04F 13/0864 52/519
2014/0208679 A1 * 7/2014 Schaefer ..... E04F 13/0832 52/704
2016/0040435 A1 * 2/2016 Schaefer ..... E04F 13/0837 52/704
2016/0160497 A1 * 6/2016 Randlett ..... E04F 13/007 52/61
2017/0081840 A1 * 3/2017 DeBuff ..... E04F 13/0833
2018/0038096 A1 * 2/2018 Kadavy ..... E04B 1/6803
2018/0127974 A1 * 5/2018 DeBuff ..... E04B 2/00
2018/0216340 A1 * 8/2018 DeBuff ..... E04B 2/00
2020/0199865 A1 * 6/2020 McEndree ..... E04B 1/64

* cited by examiner

DRIP CAP WATER MANAGEMENT DEVICE AND SYSTEM

This application claims benefit of and priority to U.S. Provisional App. No. 63/040,116, filed Jun. 17, 2020, which is incorporated herein in its entirety for all purposes.

FIELD OF INVENTION

This invention relates to an improved flashing system and apparatus for preventing water penetration behind the top of a siding panel or board.

SUMMARY OF INVENTION

In various exemplary embodiments, the present invention comprises an improved flashing system and apparatus. In several embodiments, the apparatus comprises a drip cap that is attached to the back side of a panel or board, and extends across the top thereof with a short angled drip edge extending downwards on the front side of the panel or board. The drip cap may comprise a single piece of metal (or other suitable materials, including but not limited to plastic) formed by folding or by stamping or molding. The drip cap extends longitudinally along some or all of the top of the panel or board. In some embodiments, the drip cap may extend beyond one or both ends of the panel or board.

In general configuration, the back of the drip cap comprises an upper section upward away from the top of the panel or board. It also may comprise a lower section extending downward. The lower section, if present, may be attached to the back of the panel or board by fastening means known in the art, such as, but not limited to, staples or nails. The upper section may comprise a single-thickness section (i.e., same thickness as the lower section), or, if formed by folding, a double-thickness section. A flat or slightly angled section extends horizontally (or at a small angle from the horizontal) across the top of the panel or board, and may be attached thereto, with a drip edge or lip extending downward at the front.

The present apparatus thus sits above and behind the siding panel or board, extends through the seam at the top of the siding panel or board, thereby preventing water from entering through the seam. The configuration of the apparatus causes water to be more inclined to flow toward the front side, and the drip edge causes water to fall from the apparatus at a lower point so as to prevent water from penetrating the seam under the apparatus.

DETAILED DESCRIPTION OF EXEMPLARY EMBODIMENTS

Figure 1:
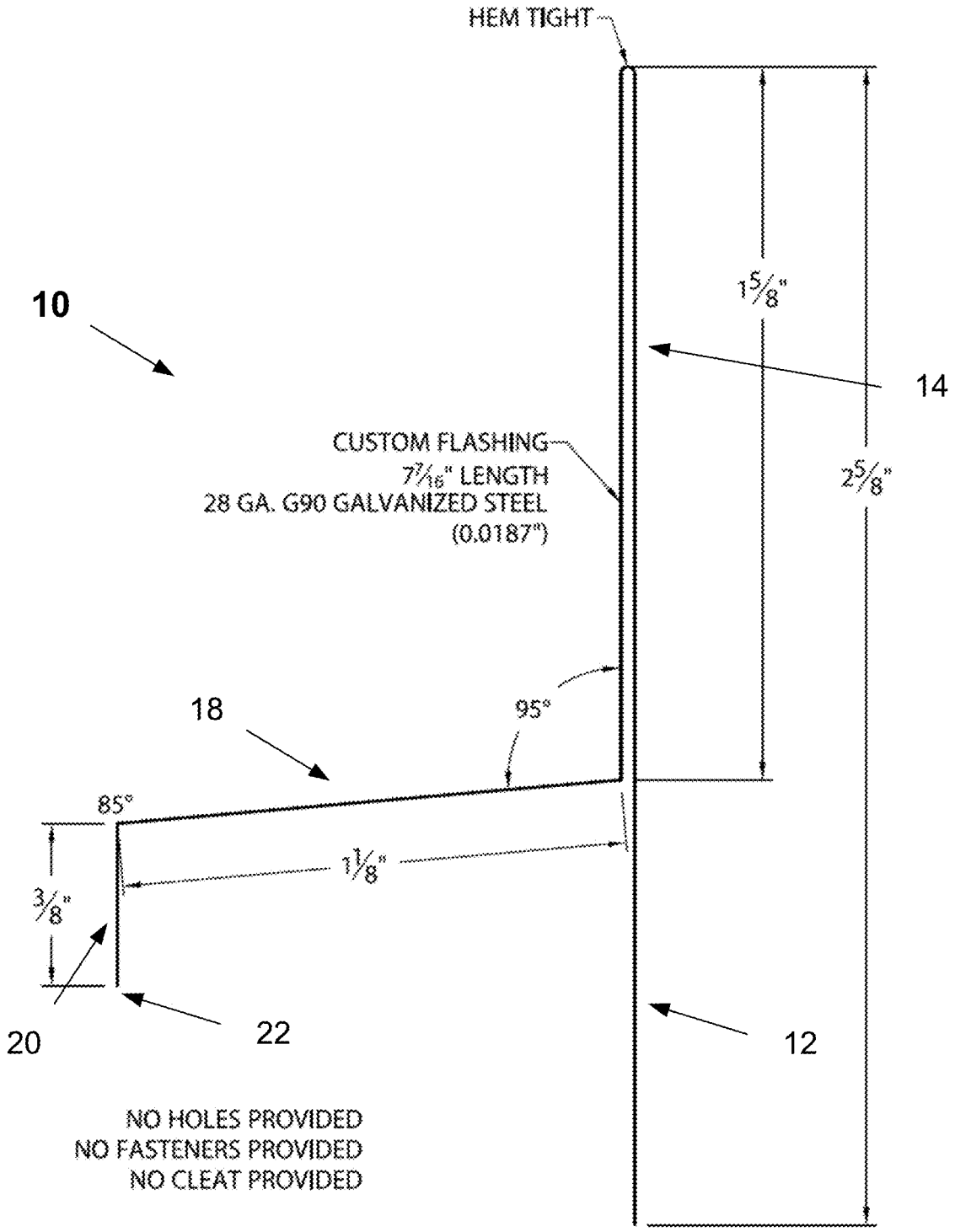
FIG. 1 shows a side view of an exemplary embodiment of a drip cap flashing device in accordance with an exemplary embodiment of the present invention.
Figure 2:
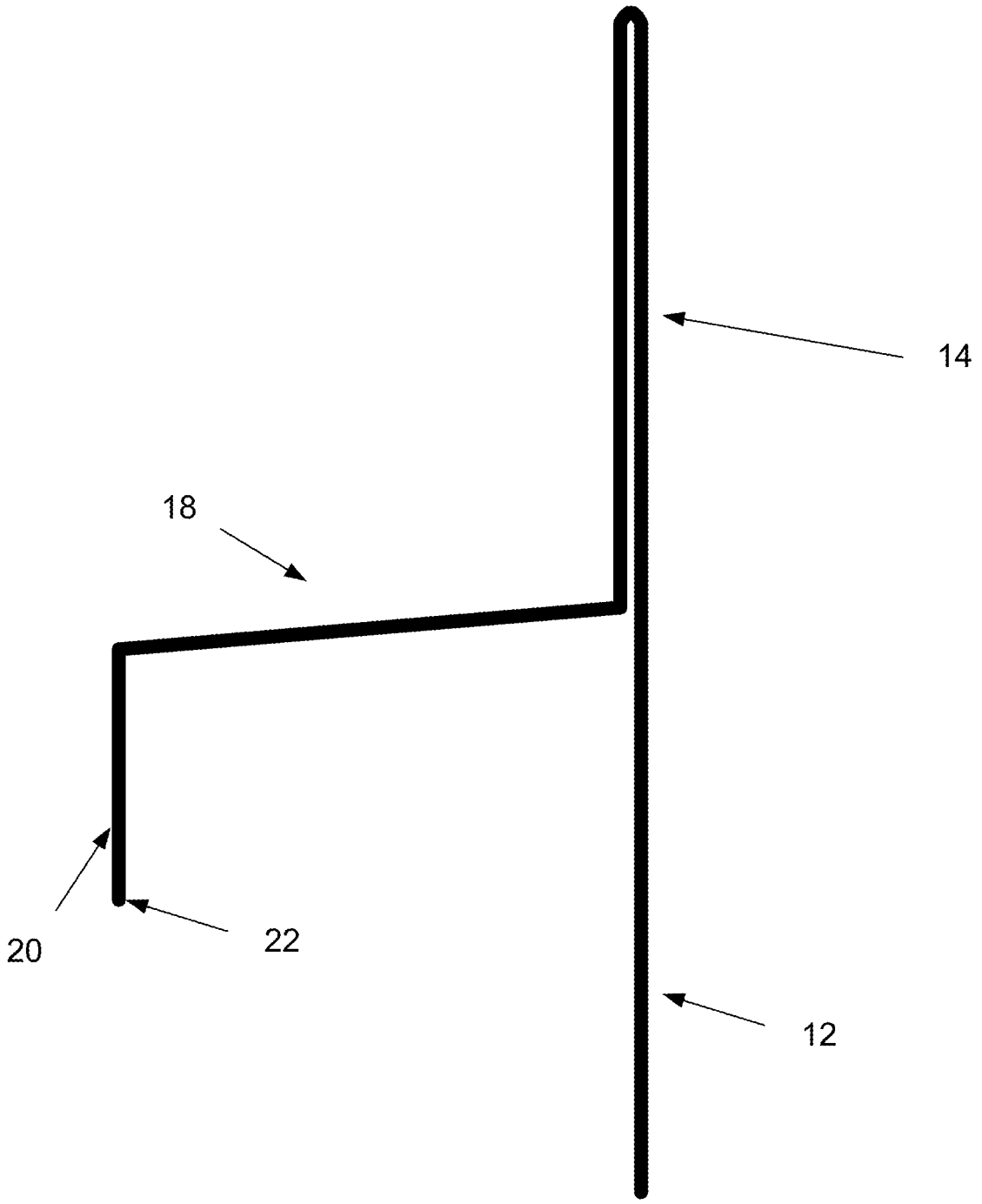
FIG. 2 shows a side view of another exemplary embodiment of the drip cap flashing device.
Figure 3:
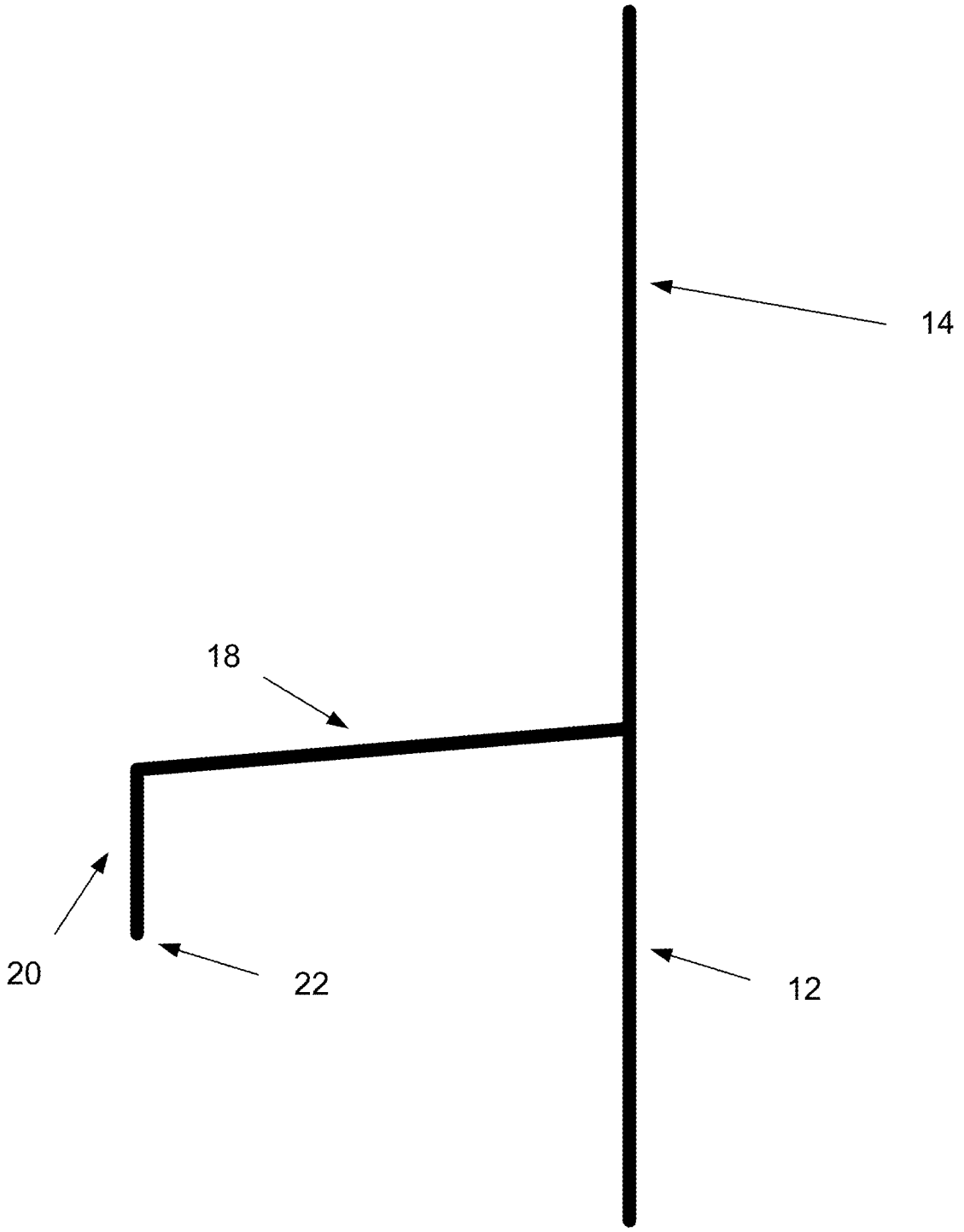
FIG. 3 shows a side view of another exemplary embodiment of the drip cap flashing device.
Figure 4:
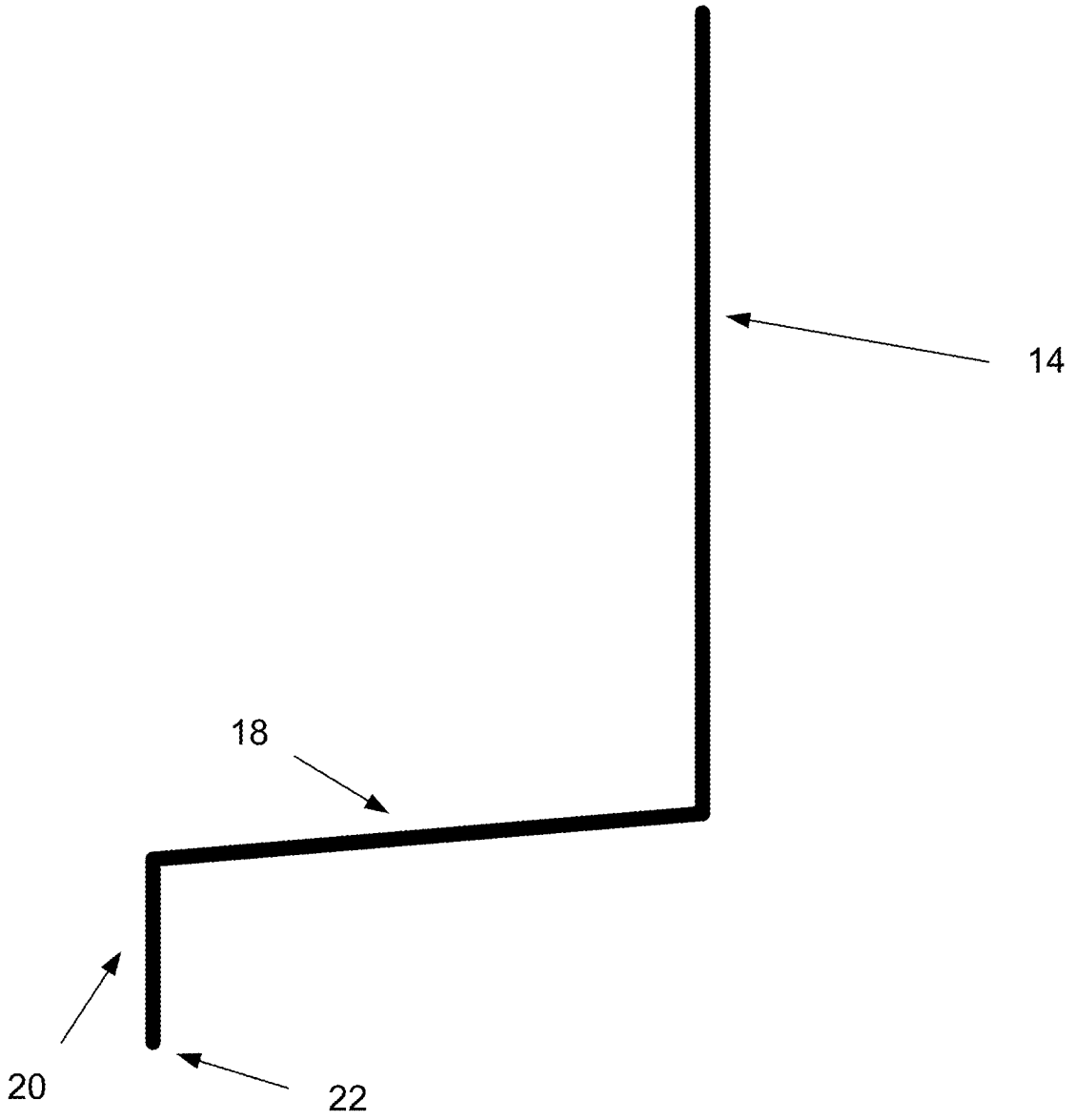
FIG. 4 shows a side view of another exemplary embodiment of the drip cap flashing device.
Figure 5:
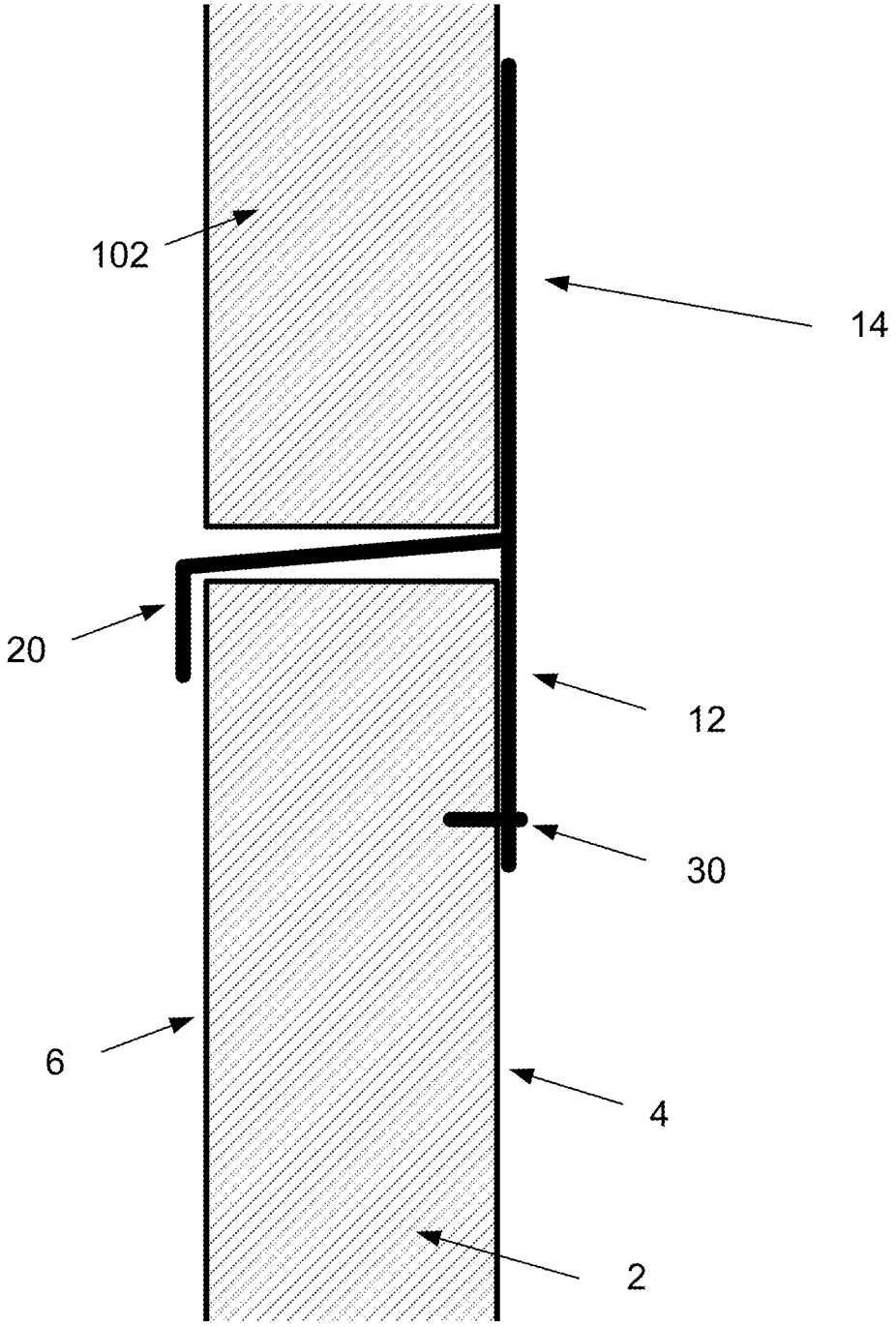
FIG. 5 shows a side cutaway view of the drip cap flashing device of FIG. 3 in position between a siding board and a higher framing component or siding board.
Figure 6:
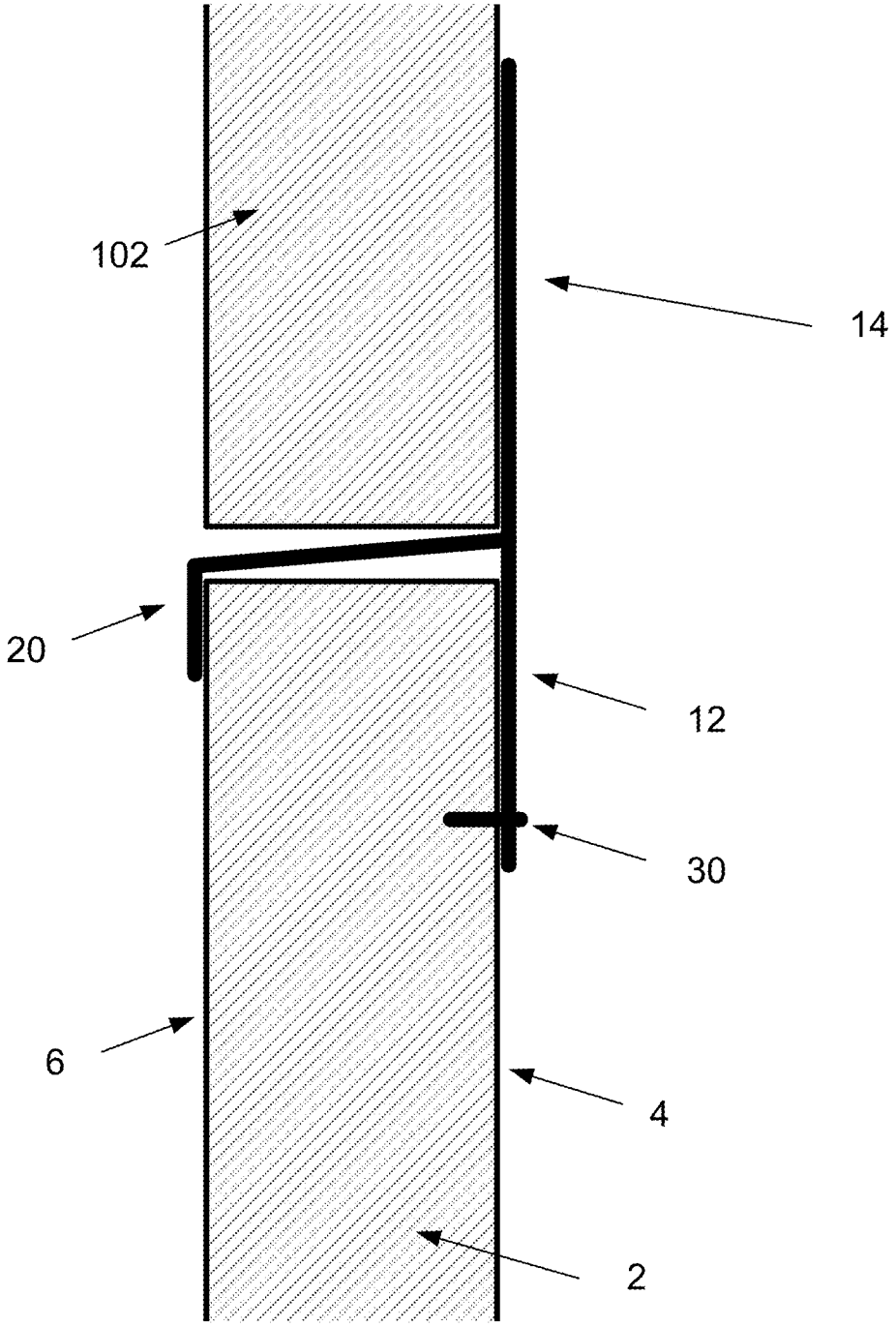
FIG. 6 shows a side cutaway view of FIG. 5 with the length of the top set so the front drip section of the drip cap flashing device is closer or in contact with the front of the siding board.
Figure 7:
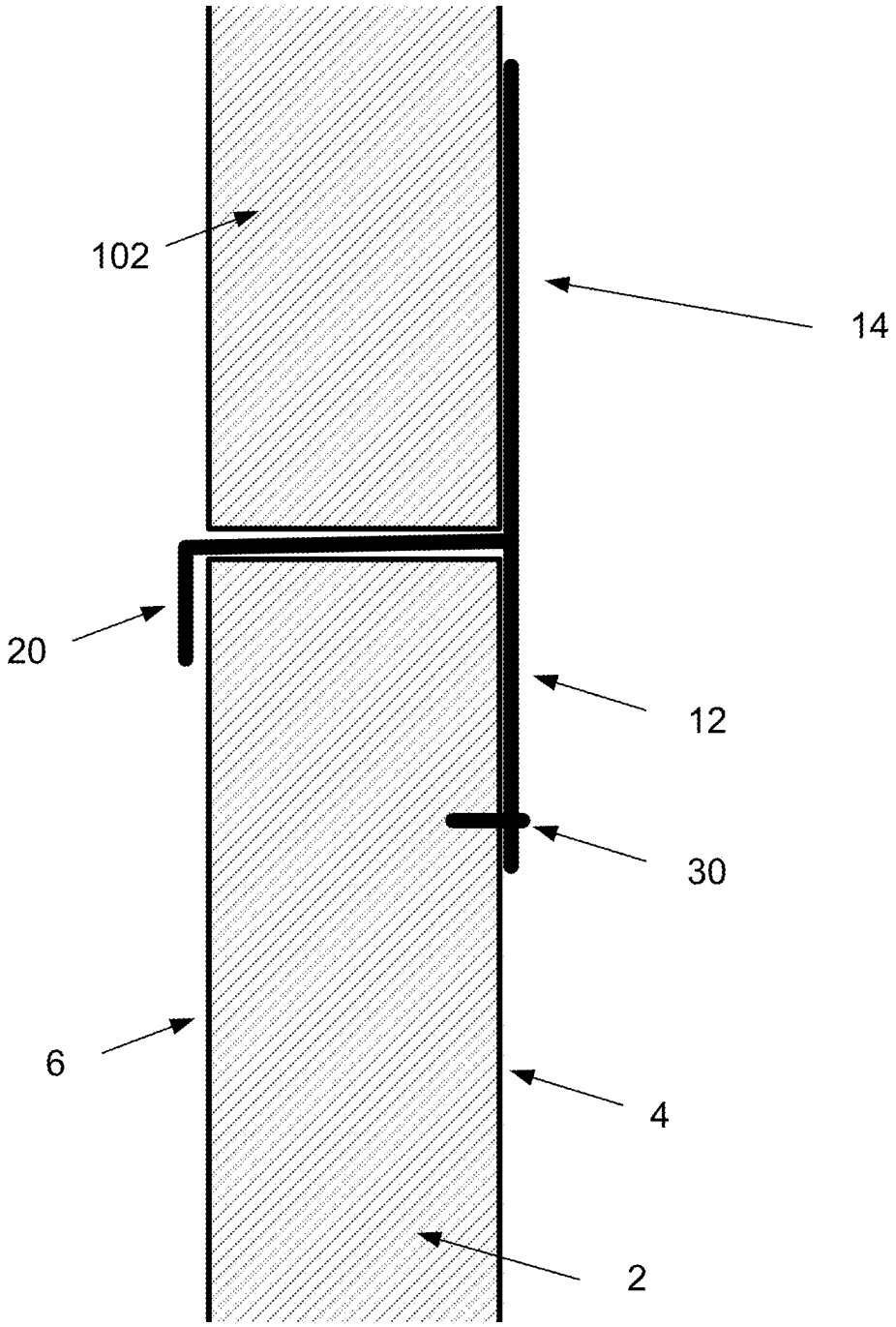
FIG. 7 shows a side cutaway view of FIG. 5 with the top of the drip cap flashing device set at a near-orthogonal angle.
Figure 8:
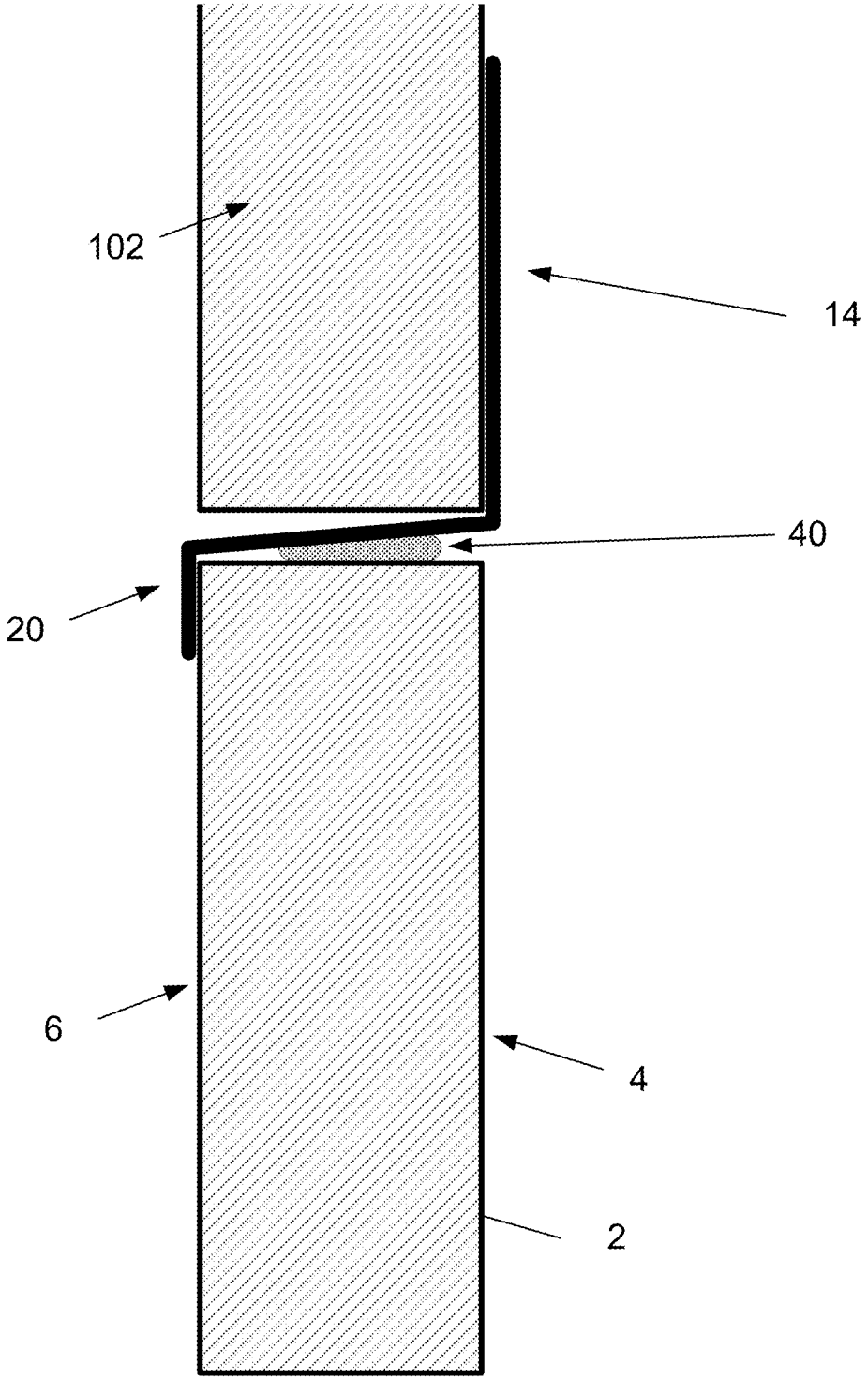
FIG. 8 shows a side cutaway view of the drip cap flashing device of FIG. 4 in position between a siding board and a higher framing component or siding board.
Figure 9:
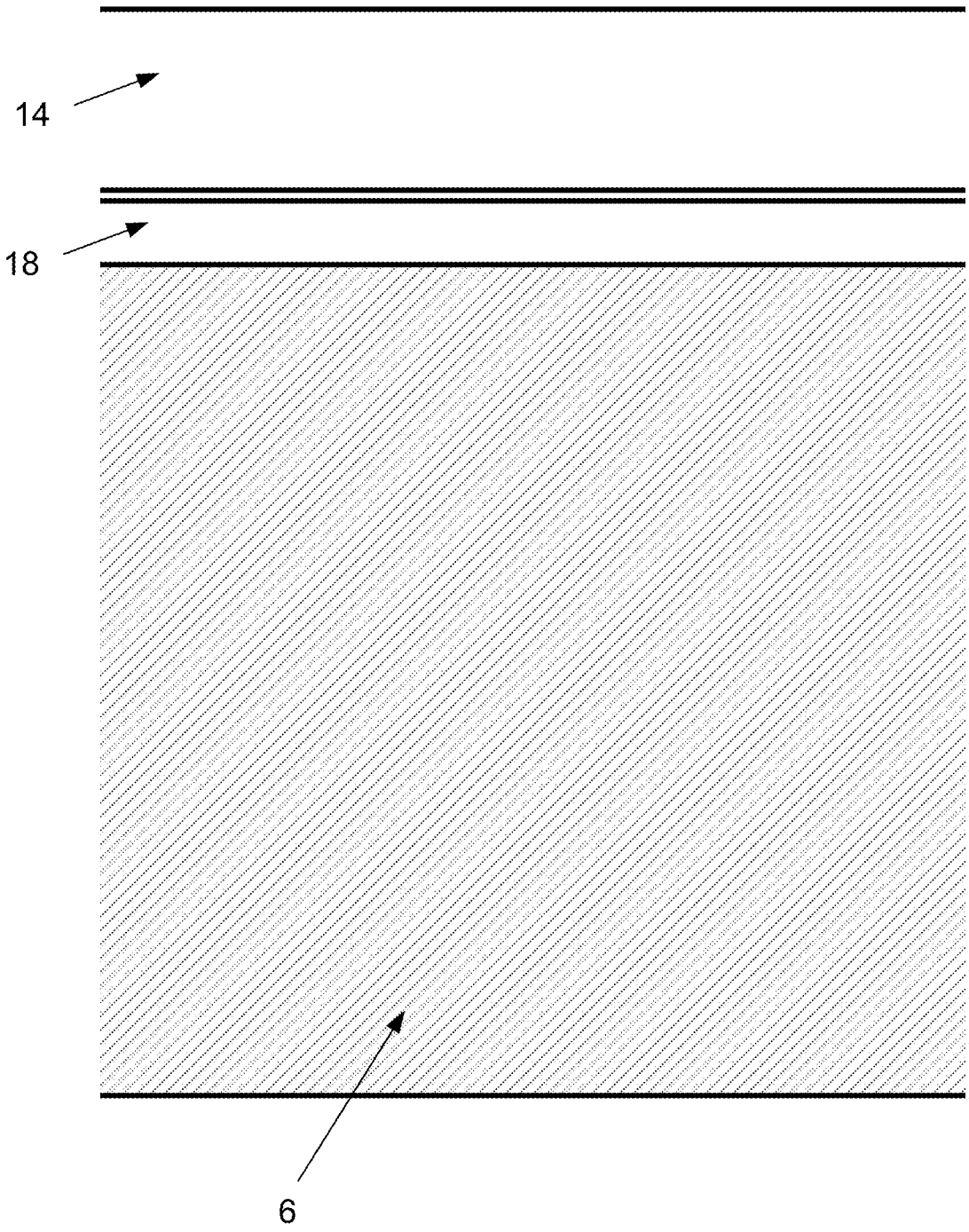
FIG. 9 shows a front view of a section of siding board with the drip cap flashing device installed on top.
Figure 10:
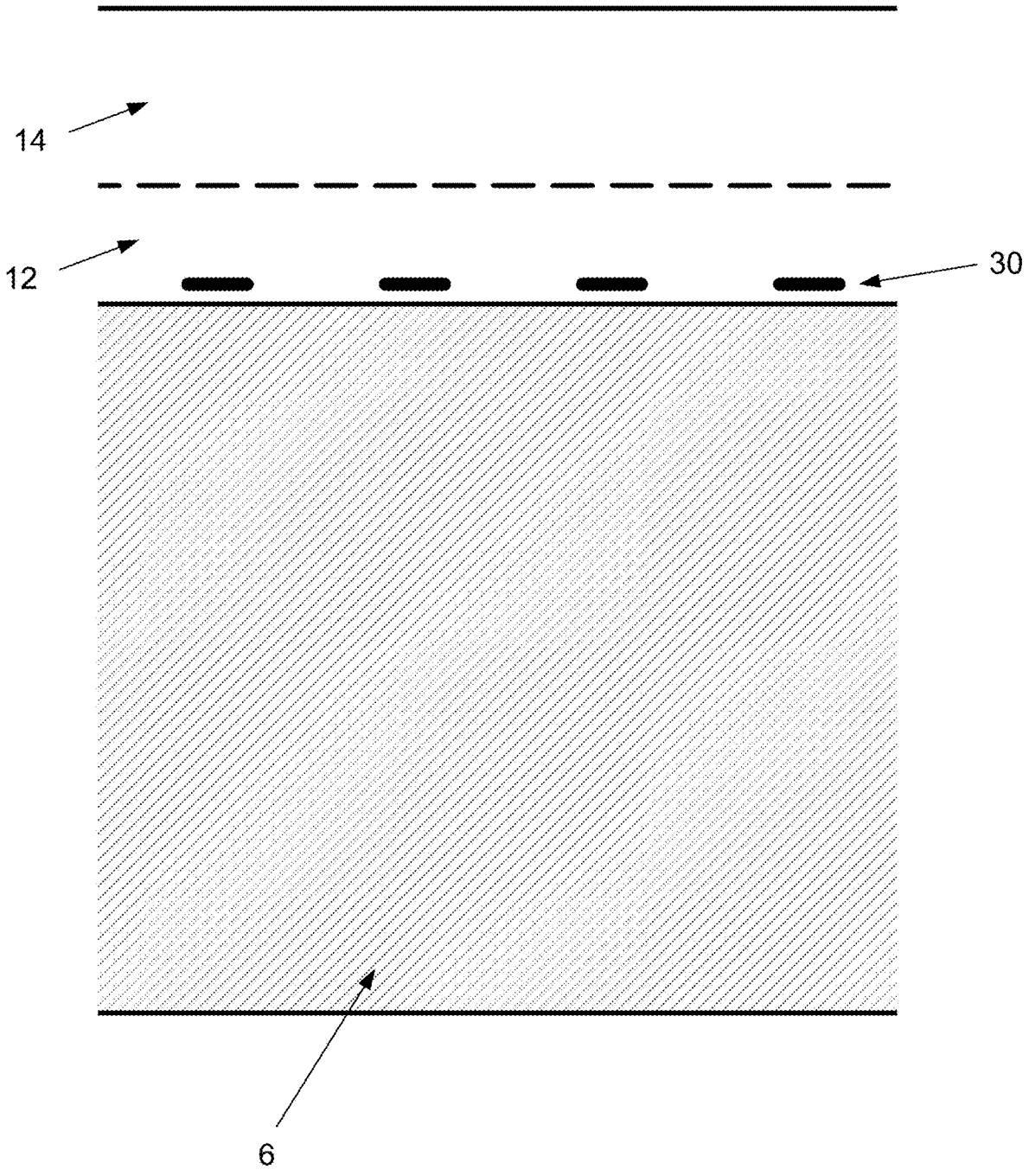
FIG. 10 shows a back view of FIG. 8 using the drip cap flashing device of FIG. 2 or 3.
Figure 11:
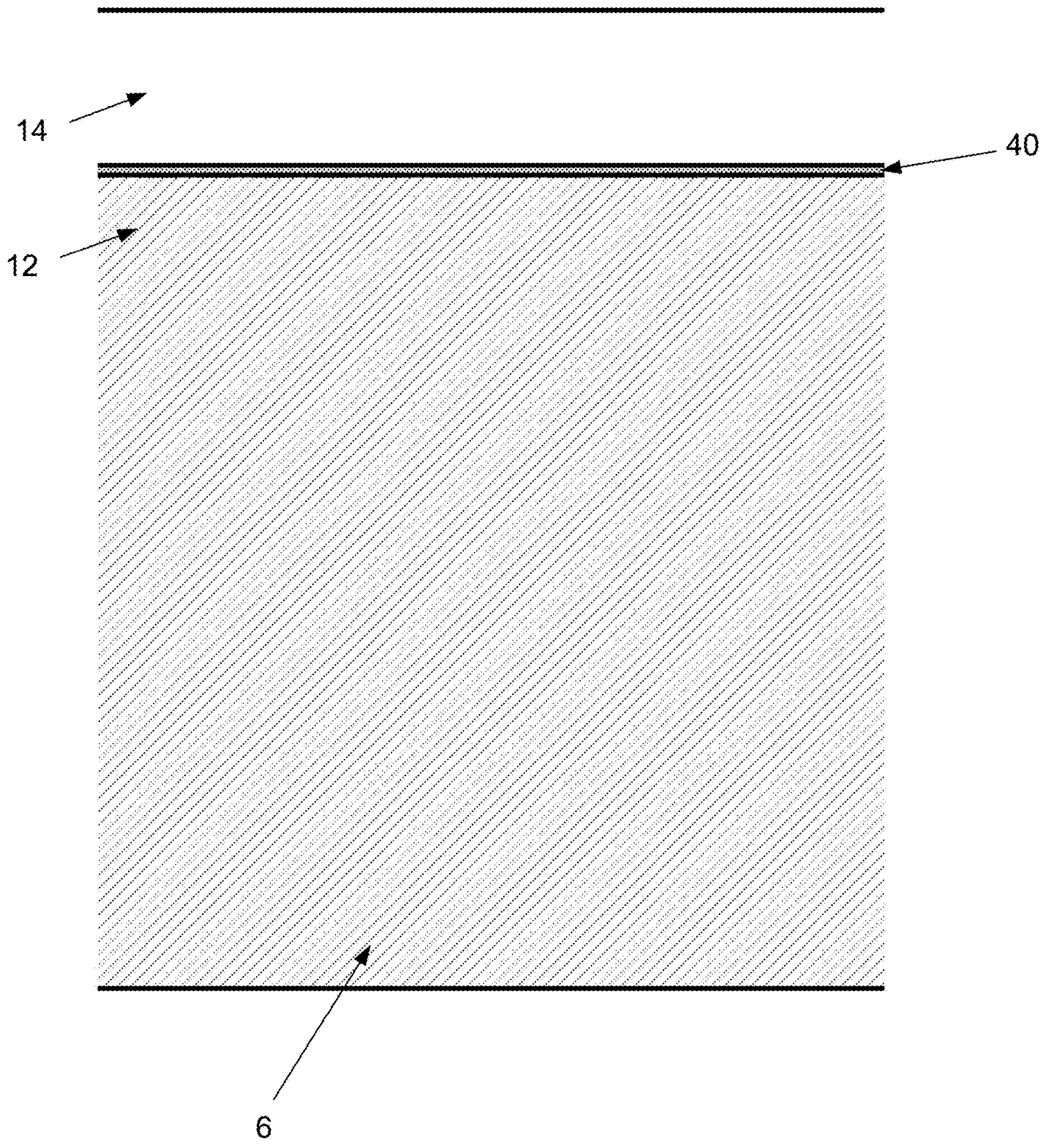
FIG. 11 shows a back view of FIG. 8 using the drip cap flashing device of FIG. 4.

In various exemplary embodiments, the present invention comprises an improved flashing system and apparatus. As seen in FIGS. 1-11, the apparatus comprises a drip cap 10 that is attached to the back side 4 of a panel or board 2, and extends across the top 8 of the panel or board with a short angled drip section 20 and edge 22 extending downwards on the front side 6 of the panel or board 2. The drip cap 10 may comprise a single piece of metal (or other suitable materials, including but not limited to galvanized steep, plastic, or the like) formed by folding (as seen in FIGS. 1, 2 and 4) or by stamping or molding (as seen in FIG. 3). The drip cap 10 extends longitudinally along some or all of the top 8 of the panel or board 2. In some embodiments, the drip cap may extend beyond one or both ends of the panel or board 2.

In the configuration seen in FIGS. 1-4, the back of the drip cap 10 comprises an upper section 14 upward away from and behind the top 8 of the panel or board 2. It also may comprise a lower section 12 extending downward, as seen in FIGS. 1-3. Where present, the lower section 12 may be attached to the back 4 of the panel or board 2 by fastening means 30 known in the art, such as, but not limited to, staples or nails (applied manually with a staple or nail gun, or by hammering) that penetrate the lower section and the back of the panel or board. Alternatively, or in addition, the drip cap may be attached to the top 8 and/or other portions of the panel or board by glue or other form of adhesive 40. As seen in FIG. 4, the flat or slightly angled top section 18 may be affixed to the top 8 of the panel by a line of glue or other adhesive means, although glue or other adhesive means may be applied in other locations as well.

In several embodiments, the height of the upper section 14 may be substantially greater than the height of the drip section 20 and/or the height of the lower section 12, if the latter is present. The height of the upper section helps prevent water or moisture from penetrating behind the upper section. Similarly, this also may help the lower section, where present, remain secure relatively tight against the back 4 of the panel. In alternative embodiments, the upper section and the lower section, when present, may be more equal in height. In several embodiments, the drip section is shorter in height than the lower section, although they also may be equal or roughly equal in height, and in some embodiments, the drip section may be greater in height than the lower section.

In certain embodiments, the apparatus has no initial holes or penetrations. Fasteners or cleats also may not be provided. There are no penetrations other than those associated with the penetrating fastening means 30, if used, and thus no penetrations other than in the lower section attached to the back of the panel or board. That is, there are no penetrations in the drip section, top section, or upper section. In various embodiments, the apparatus is thus not attached to any upper wall or framing element or siding panel or board, and is attached only to the back, top, or other portion of the panel or board on which it sits. Accordingly, in alternative embodiments where no lower section is present, there may be no penetrations, with the apparatus affixed to the panel or board on which it sits by glue or other adhesive means 40.

The upper section 14 may comprise a single-thickness section (i.e., same thickness as the lower section), as seen in FIG. 3, or, if formed by folding, a double-thickness section, as seen in FIGS. 1-2. A flat or slightly angled top section 18 extends horizontally (or at a small angle from the horizontal, with the angle sloping downwards from the back to the front) across the top of the panel or board, with a drip section 20 with a lower edge or lip 22 extending downward at the front. The top section 18 may be of a length or width slightly larger than the width or thickness of the panel or board 2, so that the drip section 20 is closer to or in contact with the front 6. In alternative embodiments, the top section 18 is longer or greater in width so that the drip section 20 is slightly further away from the front 6 and is not in contact with the front 6.

As seen in FIG. 5-8, the present apparatus thus sits behind the siding panel or board, extends through the seam at or across the top of the siding panel or board (such as may be formed by placement of the siding panel or board 2 proximate to a higher wall or framing component or element or a higher or upper siding panel or board 102), thereby preventing water from entering through the seam. The configuration of the apparatus causes water to flow toward the front side, and the drip edge causes water to fall from the apparatus at a lower point so as to prevent water from wicking up behind the drip section or otherwise penetrating the seam under the apparatus.

More particularly, the configuration of the top section and drip section, including any angles therein, promote the flow of any moisture or bulk water from the back towards the front and downward, thereby limiting water access and/or accumulation behind the back and in the seams of the boards/panels. The configuration of the drip edge ensures that water continues to flow down the outward-facing front of the panel/board, and cannot seep or flow behind the drip or top sections. Likewise, any penetrations for attachment of the drip cap to the panel/board are limited to the protected lower back section, if present, so that any water seeking to enter a seam from the front, or any water flowing down behind a higher panel/board, is directed by the drip cap through the seam towards the front and down the front section, with no opportunity for the water to seep or leak through any penetrations. The upper back section extending upward prevents water entering the seam from the front from rising up and over the back section. As discussed above, the upper back section is not attached to the higher panel/board, and thus there are no penetrations that would allow water to seep or leak through the drip cap to get behind the boards/panels.

In several embodiments, the drip cap apparatus is installed on the board or panel at a primary or second manufacturing facility, or otherwise, prior to shipping to a building location for installation. This increases efficiency in the field at the job-site or point of installation, as the drip cap apparatus is affixed to each panel in a controlled environment, not in the field.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A flashing system for siding, comprising:

a lower piece of siding, comprising a length, front side, back side, top edge, and bottom edge, wherein said lower piece of siding is arranged horizontally and with the top edge of the lower piece of siding positioned adjacent to a bottom edge of an upper wall or framing component or upper piece of siding, forming a seam therebetween;

a drip cap positioned in the seam across the top edge of the lower piece of siding, said drip cap comprising:

a front section configured to extend a first distance down a portion of the front side of the lower piece of siding and to prevent seepage behind the front section, wherein the front section comprises no holes or penetrations therein;

a top section with a front edge and a back edge, and configured to extend across the top edge of the lower piece of siding a second distance from the back side to the front side, wherein the top section slopes continuously downward from the back edge to the front edge; and an upper back section configured to extend a third distance upward from the back edge of the top section;

wherein the drip cap is attached only to the lower piece of siding.

2. The flashing system of claim 1, wherein the drip cap extends for the length of the lower piece of siding.

3. The flashing system of claim 1, wherein the drip cap has two ends, and one or both drip cap ends extend beyond respective ends of the lower piece of siding.

4. The flashing system of claim 1, wherein the drip cap has no holes or penetrations therein.

5. The flashing system of claim 1, wherein the drip cap is adhesively attached only to the top edge of the lower piece of siding.

6. The flashing system of claim 1, wherein the drip cap comprises a single, contiguous piece.

7. The flashing system of claim 6, wherein the drip cap comprises a piece of metal with a thickness, wherein the upper back portion comprises a double thickness portion of folded metal.

8. The flashing system of claim 1, wherein the drip cap further comprises a lower back section configured to extend a fourth distance down a portion of the back side of the lower piece of siding.

9. The flashing system of claim 8, wherein the third distance is greater than the fourth distance.

10. The flashing system of claim 8, wherein the drip cap is attached only by the lower back portion to the back side of the lower piece of siding.

11. The flashing system of claim 10, wherein the only holes or penetrations in the drip cap are present in the lower back portion at points of attachment.

12. A flashing apparatus for use with siding, comprising:

a contiguous drip cap comprising a front section, a top section, and a back section, said front section with a top edge and bottom edge, said top section with a front edge and a back edge, and said back section with a top edge and a bottom edge;

wherein the top section extends between the top edge of the front section and a medial line on the back section between the top edge and the bottom edge thereof, said medial line dividing the back section into an upper back section between the medial line and the back section top edge and a lower back section between the medial line and the back section bottom edge;

wherein the top section continuously forms an angle with respect to the upper back section in cross section, said angle being greater than 90 degrees; and wherein, in an installed position, the drip cap is configured to be affixed only to a single piece of siding and the front section is configured to prevent seepage therebehind.

13. The flashing apparatus of claim 12, wherein said angle is approximately 95 degrees.

14. The flashing apparatus of claim 12, wherein the medial line is closer to the back section bottom edge than the back section top edge.

15. The flashing apparatus of claim 12, wherein the drip cap has no holes or penetrations prior to installation.

16. The flashing apparatus of claim 12, wherein the drip cap is configured to be installed by fastening means only penetrating the lower back section.

17. The flashing apparatus of claim 12, wherein the drip cap comprises a single, contiguous piece.

18. The flashing apparatus of claim 17, wherein the drip cap comprises a piece of folded metal with a thickness, wherein the upper back section comprises a double thickness section of folded metal.

19. The flashing apparatus of claim 17, wherein the drip cap comprises a molded piece of plastic or metal.

* * * * *